US005152565A

United States Patent [19]

Dodd

[11] Patent Number: 5,152,565

[45] Date of Patent: Oct. 6, 1992

[54] GOLF BALL RETRIEVER

[76] Inventor: Samuel E. Dodd, 849 Oak Vista Dr., Sarasota, Fla. 34232

[21] Appl. No.: 709,231

[22] Filed: Jun. 3, 1991

[51] Int. Cl.[5] ..... A63B 47/02

[52] U.S. Cl. ..... 294/19.2; 414/440

[58] Field of Search ..... 294/19.2, 66.1; 56/327.1, 328.1, 332, 400.01, 400.02; 171/58, 63, 108; 172/349, 350, 604; 414/437, 439, 440

[56] References Cited

U.S. PATENT DOCUMENTS

| | | | |
|---|---|---|---|
| 771,886 | 10/1904 | Smith | 294/19.2 |
| 1,099,540 | 6/1914 | Douglass | 414/440 X |
| 1,911,535 | 5/1933 | Schultze | 56/400.02 |
| 2,365,540 | 12/1944 | Fonken | 294/19.2 X |
| 2,539,596 | 1/1951 | Smith | 414/440 X |
| 2,658,637 | 11/1953 | Bailey | 414/440 |
| 3,215,293 | 11/1965 | Kelly et al. | 294/19.2 X |
| 3,227,298 | 1/1966 | Shoemaker | 294/19.2 X |
| 3,437,368 | 4/1969 | Anderson | 294/19.2 |
| 3,744,225 | 7/1973 | Reeves | 56/328.1 |
| 3,748,838 | 7/1983 | Woodfill | 294/19.2 X |
| 3,788,506 | 1/1974 | Lee | 294/19.2 X |
| 3,823,838 | 7/1974 | Gustafson et al. | 414/440 |
| 4,254,981 | 3/1981 | Wilson | 294/19.2 |
| 4,318,654 | 3/1982 | Lee | 294/19.2 X |
| 4,645,254 | 2/1987 | Warden | 294/19.2 |
| 4,744,593 | 5/1988 | Spielman et al. | 294/19.2 |
| 4,761,026 | 8/1988 | Warden et al. | 294/19.2 |
| 4,984,836 | 1/1991 | Redding | 294/19.2 X |
| 4,991,896 | 2/1991 | Martin | 294/19.2 |

FOREIGN PATENT DOCUMENTS

| | | | |
|---|---|---|---|
| 845706 | 8/1960 | United Kingdom | 56/400.02 |

*Primary Examiner*—Johnny D. Cherry
*Attorney, Agent, or Firm*—Staas & Halsey

[57] ABSTRACT

A golf ball retriever is provided for retrieving balls by providing at least two discs mounted on a rotatable shaft. The discs have a distance therebetween slightly greater than the diameter of the ball. A foam-rubber ring is concentrically attached to an inside surface of each disc to provide for an easy pick-up of the ball. Each of the discs are scallop-shaped to provide a greater vertical downward force on the ball than a horizontal force when pivoting on a scallop point. Radial slits are formed in each disc extending from a low point of each scallop. Counter sunk holes are formed on the inside surface of each disc at the ends of the radial slits.

5 Claims, 2 Drawing Sheets

GOLF BALL RETRIEVER

BACKGROUND OF THE INVENTION

1. Technical Field

The present invention relates to an implement for retrieving golf balls or the like and, more particularly, relates to a golf ball retrieving implement having scallop-shaped discs and a rubber ring concentrically glued on an inside surface of each disc.

2. Description of the Related Art

Various devices have been proposed in the art for retrieving golf balls, especially golf balls that are not readily visible and/or difficult to reach or get at (i.e. in a water trap). Such devices have been proposed in the following U.S. Pat. Nos.:

| U.S. Pat. No. | Inventor(s) | Issue Date |
|---|---|---|
| 771,886 | Smith | October 11, 1904 |
| 2,365,540 | Fonken | December 19, 1944 |
| 3,227,298 | Shoemaker | January 4, 1966 |
| 3,437,368 | Anderson | April 8, 1969 |
| 3,748,838 | Woodfill | July 31, 1973 |
| 3,788,506 | Lee | January 29, 1974 |
| 4,254,981 | Wilson | March 10, 1981 |
| 4,318,654 | Lee | March 9, 1982 |
| 4,645,254 | Warden | February 24, 1987 |
| 4,744,593 | Spielman et al. | May 17, 1988 |
| 4,761,026 | Warden et al. | August 2, 1988 |
| 4,984,836 | Redding | January 15, 1991 |
| 4,991,896 | Martin | February 12, 1991 |

A golf ball can be difficult to pick-up in a water trap because it slides along the mud in the water trap. A golf ball can also be difficult to pick-up in a water trap when the water is murky and the ball cannot be seen.

The present invention solves the above-mentioned and other problems and provides a golf ball retriever having advantages and features not heretofore possible.

SUMMARY OF THE INVENTION

It is an important object of the present invention to provide an implement for retrieving golf balls or the like.

It is another important object of the present invention to provide a golf ball retriever having two discs with a space therebetween less than the diameter of a golf ball and having a rubber ring concentrically glued on an inside surface of each disc to provide for easier pick-up of a ball and a more reliable grasp on a picked-up ball.

A further important object of the present invention is to provide at least two scallop-shaped discs so that during rotation of the disc through an angle corresponding to a scallop, the golf ball retriever provides a greater vertical downward force on the golf ball than horizontal forward force to retard any forward motion and enable easy pick-up of the ball.

An additional important object of the present invention is to provide a golf ball retriever having at least two scallop-shaped discs spaced a distance greater than the diameter of a golf ball and having a rubber ring concentrically glued in a recess on an inside surface of each disc so that pick-up of the golf ball is aided by the scallop shape and so that the rubber rings hold a plurality of balls therein like ball bearings.

Another important object of the present invention is to provide a golf ball retriever having at least two discs spaced a distance greater than the width of a golf ball and having a rubber ring concentrically glued on an inside surface of each disc, each rubber ring having a beveled surface on at least the outside perimeter of the rubber ring to aid in the pick-up and holding of the golf balls between the discs.

Another additional important object of the present invention is to provide a golf ball retriever having at least two scallop-shaped discs with radial slits formed therein and extending from a low point of each scallop to a counter sunk hole formed in the disc so that the slits provie spring-like flexibility and so that the counter sunk hole slows down travel of the golf ball when it is held between the discs.

The present invention provies a golf ball retriever for retrieving balls, comprising a rotatable shaft, at least two discs mounted on the rotatable shaft with a distance therebetween slightly greater than the diameter of the ball, and a flexible ring concentrically attached to an inside surface of each disc. Each disc is scallop-shaped to provide a greater vertical downward force on the ball than horizontal force. Each disc further has a plurality of radial slits formed therein extending from a low point of each scallop. Each radial slit has a length approximately two-thirds of the length of the disc's radius. Each disc further has counter sunk holes formed therein on the inside surface of the disc, each radial slit extending from the low point of each scallop to the counter sunk hole. A yoke and telescopic handle are connected to the rotatable shaft.

The above-mentioned and other important objects and features of the present invention will become apparent from the following description when read in conjunction with the accompanying drawings.

DETAILED DESCRIPTION OF THE PREFERRED EMBODIMENTS

Figure 1:
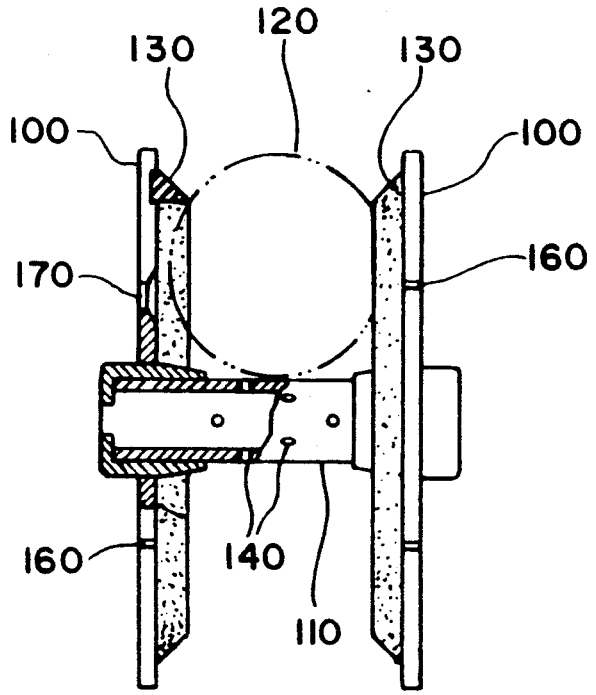
FIG. 1 is a top view of the golf ball retriever of the present invention.

FIG. 1 illustrates a top view of the golf ball retriever of the present invention. Two discs 100 are radially mounted near the ends of rotatable axis 110. The discs 100 preferably have a diameter of approximately 3¾ inches. The rotatable shaft 110 preferably has a diameter of approximately ⅜ inches. However, it can be appreciated that the diameter of the disc 100 is dependent upon the diameter of the rotatable shaft 110 and the size of the ball 120.

The discs 100 are spaced with a width therebetween greater than the diameter of the ball 120. A foam-rubber ring 130 is concentrically glued in a recess on the inside surface of each disc 100 to hold the golf balls between the discs 100. The foam-rubber ring 130 is preferably made of a closed cell material so that it will not absorb water. A rubber named BUNA has been found to work best) however other rubbers are possible. The rubber BUNA is an underwater rubber used in underwater swimming pool cleaning devices manufactured by Aladin. If the golf ball retriever is not intended to be used underwater or if it is intended to be used to retrieve balls other than golf balls, different materials for the ring may be preferred such as spring wire or a concentric ridge is formed of or in the material of the disc 100.

The foam-rubber rings 130 preferably have a beveled edge to assist in retrieval of the ball. The edge can be beveled on only the outside surface as illustrated in FIG. 1 or can be beveled on both the outside and the inside surfaces so as to form a triangular cross-section or a shape similar to an inverted Z with the top portion chopped off and a line drawn to attach the ends of the other two portions. The bevel on the foam-rubber ring 130 should be of a shape that aids pick-up of the golf ball therebetween but holds the golf ball 120 therein. Preferably, the golf ball 120 rides or travels like a ball-bearing between the rotatable shaft 110 and an inside surface of the foam-rubber rings 130.

The foam-rubber rings 130 are preferably approximately ¼ inch wide and preferably recessed approximately 1/32nd of an inch into the discs 100. The foam-rubber ring can be glued inside the recess preferably using PVC glue or the like. Alternatively, the foam-rubber ring can be snapped onto protrusions on the disc 100 or snapped into recesses in the disc 100.

The disc 100 and the rotatable shaft 110 are preferably made of a PVC plastic material. However, they can be made from wood or other metallic materials as fit for a specific application. The embodiment of FIG. 1 illustrates rotatable shaft 110 made from a ½ inch PVC pipe having sealing end pipe caps on both ends. Holes 140 are drilled in the rotatable shaft 110 to provide drainage for water.

Figure 2:
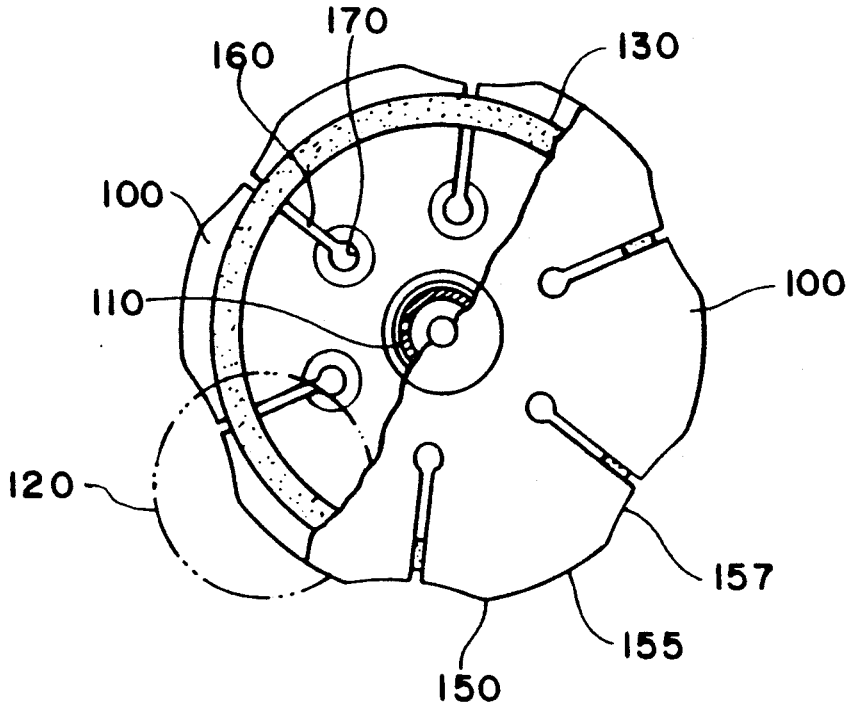
FIG. 2 is a side view of the golf ball retriever of the present invention.

FIG. 2 illustrates a side view of the golf ball retriever of the present invention. The perimeter of each disc 100 is scallop-shaped to assist in the delivery of the golf balls to the inner portion between the discs. The scalloped-shaped disc provides a greater vertical downward force than horizontal forward force on the ball 120 during an angular rotation corresponding to one scallop. This assists in pushing the golf ball through the foam-rubber rings 130 so that the ball 120 can ride or travel between the rings 130 and the rotatable shaft 110. Specifically, the vertical downward force is greater than the horizontal forward force when the discs 100 pivot on the scallop point 150 illustrated in FIG. 2. The scallop shape of the discs 100 can vary from that illustrated in the drawings, and accordingly, the discs 100 can be shaped with square or triangular indentations rather than the illustrated concave indentations as long as pivoting at a point-like scallop point 150 is realized.

The discs 100 have radial slits 160 extending from a low point of each scallop to a counter sunk hole 170 formed therein. The radial slits have a length approximately ⅔ of the length of each disc's radius. The slits 160 provide spring-like flexibility so that the balls 120 can be picked up between the discs 100. The beveled holes 170 have the bevel on the inside of the discs and act to slow down travel of the ball between the foam-rubber rings 130 and the rotatable shaft 110.

Figure 3:
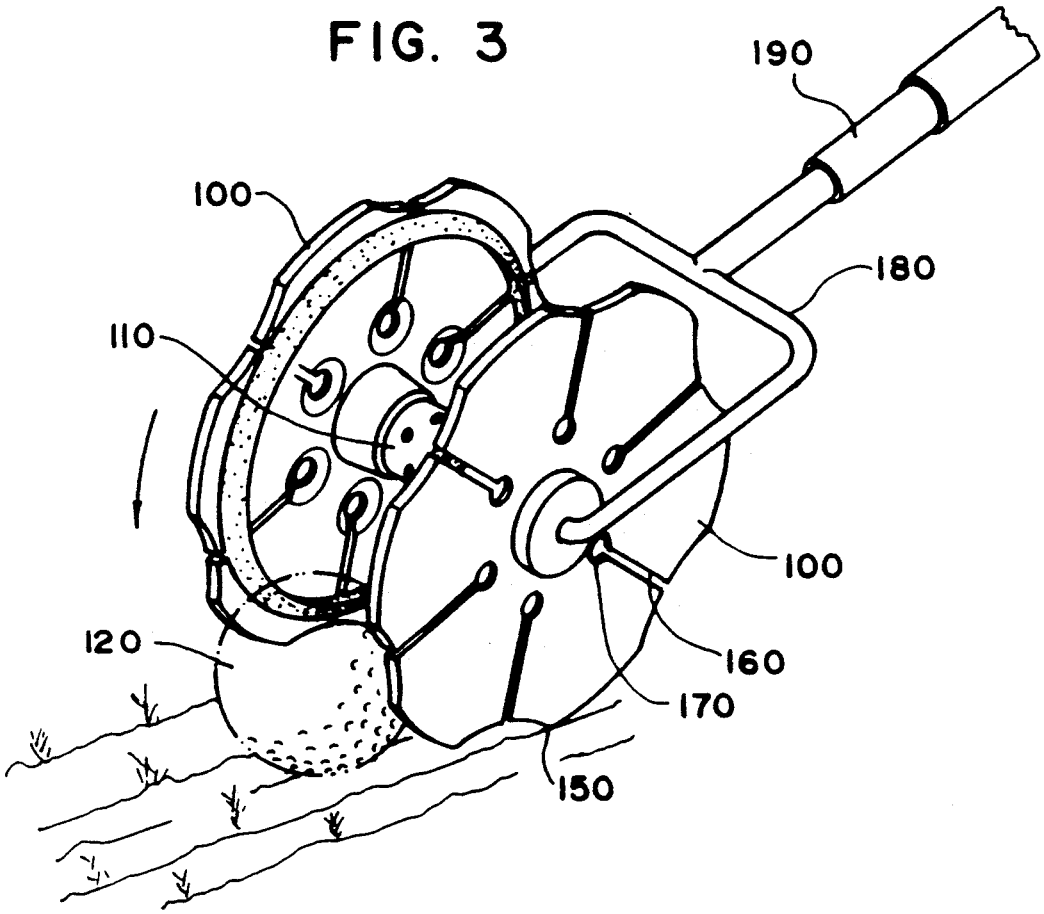
FIG. 3 is a three-dimensional view of the golf ball retriever of the present invention.

FIG. 3 is a three-dimensional view of the golf ball retriever of the present invention. A yoke 180 attaches to the rotatable member 110 and provides an axis for rotation. A handle 190, preferably telescoping, is attached to yoke 180. The adjustable length of handle 190 enables retrieval of golf balls deep in water traps. As can be seen from FIG. 3, the vertical downward force on the ball 120 is greater than the horizontal forward force when pivoting on scallop point 150.

Figure 4:
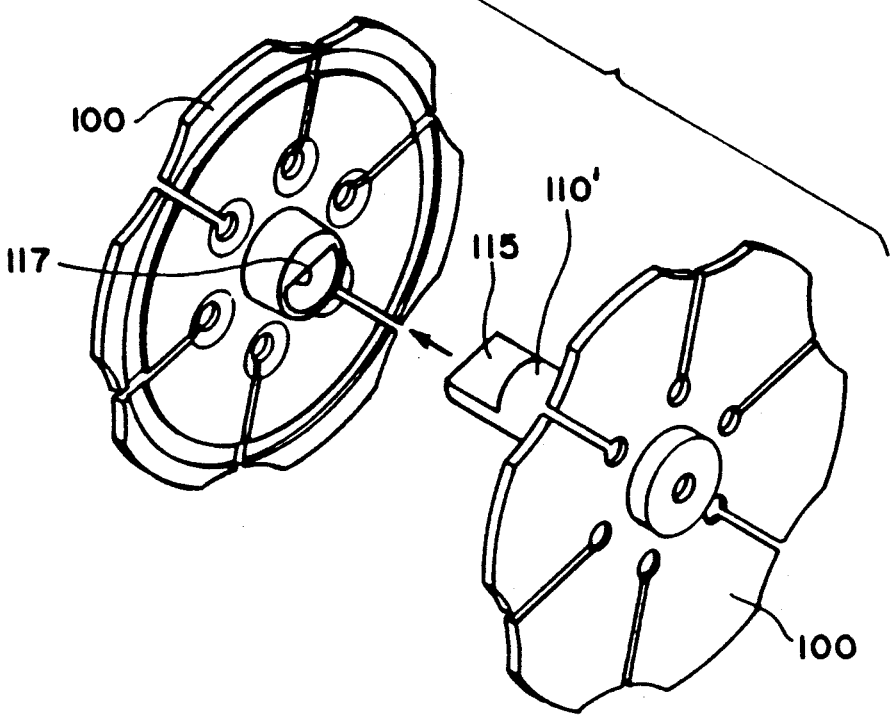
FIG 4 is a three-dimensional view of another embodiment of the golf ball retriever of the present invention.

FIG. 4 illustrates another preferred embodiment of the present invention. Rotatable shaft 110 can be formed as part of one of the discs 100 by an injection molding process. Another of the discs can be formed by injection molding with a D-shaped hole therein. The rotatable shaft 110 would have a D-shaped male part 115 which fits in D-shaped hole 117. Yoke 180 can also be molded by the same injection molding process that creates discs 100 and rotatable shaft 110'. The handle 190 then attach to the injection molded yoke 180. Such allows for a simple construction.

While the invention has been illustrated and described in detail in the drawings and foregoing description, it will be recognized that many changes and modifications will occur to those skilled in the art. Other balls, such as tennis, baseball, basketball, soccer, racquet ball, squash, handball, ping-pong or even ball bearings can be accommodated by changes in size and spacing of the disc and changes in the type of material for the rings 130. More than two discs can also be mounted along the same axis. The inner discs would then have rings on both surfaces. It is therefore intended, by the appended claims, to cover any such changes and modifications as fall within the true spirit and scope of the invention.

What is claimed is:

1. A golf ball retriever for retrieving balls, comprising:

a rotatable shaft;

a plurality of discs radially mounted on said rotatable shaft with a distance therebetween slightly greater than the ball's diameter, each of said discs having a plurality of pairs of scallop points on a perimeter thereof, a concave indentation extending between each pair of said scallop points and a plurality of radial slits formed therein extending from a low point of each concave indentation towards the rotatable shaft; and a friction member concentrically attached to an inside surface of each of said discs.

2. A golf ball retriever according to claim 1, wherein each of the radial slits has a length approximately two-thirds of each of said discs' radius.

3. A golf ball retriever according to claim 1, wherein each of said discs further has counter sunk holes formed therein on the inside surface of said discs.

4. A golf ball retriever according to claim 1, further comprising a yoke and a handle connected to said rotatable shaft.

5. A golf ball retriever according to claim 1, wherein said friction member comprises a rubber ring concentrically attached to the inside surface of each of said discs.

* * * * *